US005201781A

United States Patent [19]

Jestädt et al.

[11] Patent Number: 5,201,781

[45] Date of Patent: Apr. 13, 1993

[54] COUPLING FOR THE CUTTER ASSEMBLY OF TWIN-HEAD SHAVERS

[75] Inventors: Albrecht Jestädt, Friedrichsdorf; Helmut Dürr, Frankfurt; Hans-Eberhard Heintke, Wächtersbach, all of Fed. Rep. of Germany

[73] Assignee: Braun Aktiengesellschaft, Kronberg, Fed. Rep. of Germany

[21] Appl. No.: 829,068

[22] PCT Filed: Jul. 21, 1990

[86] PCT No.: PCT/DE90/00550

§ 371 Date: Feb. 6, 1992

§ 102(e) Date: Feb. 6, 1992

[87] PCT Pub. No.: WO91/02629

PCT Pub. Date: Mar. 7, 1991

[30] Foreign Application Priority Data

Aug. 16, 1989 [DE] Fed. Rep. of Germany ..... 3926894

[51] Int. Cl.[5] ..... B26B 19/02

[52] U.S. Cl. ..... 30/43.92; 30/43.91

[58] Field of Search ..... 30/43.92, 43.91, 209, 30/43.8, 43.9

[56] References Cited

U.S. PATENT DOCUMENTS

| | | | |
|---|---|---|---|
| 3,044,168 | 7/1962 | Kachline | 30/43 |
| 3,408,736 | 11/1968 | Kobler | 30/43.92 |
| 3,931,675 | 1/1976 | Czesner et al. | 30/43.92 |
| 4,219,930 | 9/1980 | Franko et al. | 30/43.92 |
| 4,233,733 | 11/1980 | Gallanis et al. | 30/43.92 |
| 4,700,476 | 10/1987 | Locke et al. | 30/43.91 |
| 4,796,359 | 1/1989 | Oprach | 30/43.92 |
| 4,805,300 | 2/1989 | Miska | 30/43.92 |

FOREIGN PATENT DOCUMENTS

| | | | |
|---|---|---|---|
| 2429539 | 1/1975 | Fed. Rep. of Germany | 30/43.92 |
| 2624601 | 5/1976 | Fed. Rep. of Germany . | |
| 57-135365 | 8/1982 | Japan . | |
| 2036631 | 7/1980 | United Kingdom . | |

*Primary Examiner*—Frank T. Yost
*Assistant Examiner*—Hwei-Siu Payer
*Attorney, Agent, or Firm*—Fish & Richardson

[57] ABSTRACT

The invention is directed to a dry shaving apparatus comprising a pair of parallel shaving heads having their inner cutters resiliently mounted on a common coupling member which is adapted to be coupled to the drive member of the electric drive by means of a plug-in connection and is detachable against the pressure of a spring element.

12 Claims, 4 Drawing Sheets

COUPLING FOR THE CUTTER ASSEMBLY OF TWIN-HEAD SHAVERS

This invention relates to a dry shaving apparatus comprising a pair of parallel elongate shaving heads having their inner cutters resiliently mounted on a common coupling member which is detachably coupled to the drive member of the electric drive.

A dry shaving apparatus of the type initially referred to is known from JP-U 57-135 365. As becomes apparent from FIGS. 2 and 3 of this specification, the drive means for the two parallel inner cutters is comprised of a single component, that is, an oscillating bridge, a coupling member integrally formed on the oscillating bridge, and two drive pins which are integrally formed on the coupling member and on which the inner cutters are resiliently mounted and held by means of a clip connection.

From DE-OS 2,624,601 a dry shaving apparatus with parallel shaving heads is known in which the inner cutters are detachably arranged on a common coupling member. The coupling member is resiliently mounted on the drive member and coupled thereto by means of a swivel-type fastener. During shaving, this type of resilient support for the inner cutters does not permit separate spring loading of the respective inner cutters in dependence on the different skin—engaging pressures to which they are exposed.

It is an object of the present invention to provide a dry shaving apparatus of the type initially referred to in such a manner as to afford reliability and ease of handling, coupling and decoupling of its inner cutters together with a drive member of the dry shaving apparatus, while the resilient support and engagement associated with each inner cutter upon and, respectively, with the upper cutter or cutters are maintained.

According to the present invention, this requirement is satisfied in an apparatus of the type initially referred to in that the coupling member is coupled to the drive member by means of a bearing pin engaging in a bearing bore provided in the drive member, the coupling member being held in abutting engagement with the drive member by means of at least one spring element locking into a prismatic groove having two beveled surfaces and provided on the bearing pin, the spring element resting resiliently against one of the beveled surfaces in the locked position, and the locking device which is comprised of the spring element and the prismatic groove being releasable from its locking engagement against the pressure of the spring element by means of one of the beveled surfaces of the prismatic groove against which the spring element rests.

The coupling of the two inner cutters to a drive member of the electric drive by means of a common coupling member — while the resilient support and engagement associated with each inner cutter upon and, respectively, with the upper cutter or cutters are thus maintained — affords, apart from its ease of handling, the particular advantage of being suitable for use in both dry shaving apparatus having a pivoted shaving head (FIGS. 1, 2 and 3) and dry shaving apparatus in which the shaving head is detachable from the casing but otherwise immovably arranged thereon. This type of coupling allows ready removal of the assembly comprised of the two inner cutters and the coupling member either for replacement due to wear of the inner cutters or for improved cleaning of the assembly, including the respective shaving head frame.

Reliable abutting engagement of the coupling member with the drive member regardless of tolerances is ensured in that the beveled surfaces of the prismatic groove on the bearing pin have different gradients, the beveled surface with the smaller gradient being acted upon by the spring element in the coupled condition of coupling member and drive member.

A particularly advantageous embodiment of the invention is characterized in that the bearing bore terminates in a hollow space provided in the drive member, and that the spring element includes at least one spring arm which extends into the hollow space and is integrally formed on the drive member in an extension of the bearing bore.

In a variation of this embodiment of the invention, the drive member is part of an oscillating bridge arranged in the shaving head frame of the dry shaving apparatus. In a further embodiment, the drive member is part of an oscillating bridge arranged in the casing of the dry shaving apparatus.

In another advantageous embodiment of the invention, the drive member is comprised of an oscillating drive pin having a bearing bore arranged on its center axis and a groove provided on the outside of the bearing bore wall for receiving the spring element, the groove partially intersecting the space in the interior of the bearing bore. In a variation of this embodiment, the spring element is a spring clip conformed to the contour of the groove and partially extending into the space in the interior of the bearing bore.

In a further embodiment of the invention, positive-engagement means suitable for relative engagement and determining the alignment of the inner cutters are arranged on the coupling member and on the drive member. Suitably, in such an embodiment the coupling member and the drive member are each provided with two positive-engagement means extending parallel to the direction of oscillation of the inner cutters for alignment of the two inner cutters in the direction of oscillation. In order to allow cleaning of the shaving head frame as well as of the two inner cutters in coupled condition with the drive, in a still further embodiment of the invention the coupling member and the drive member are each provided with four positive-engagement means, such that the common center axis of bearing bore and bearing pin extends through the point of intersection of the directions in which the positive-engagement means extend, the directions intersecting at right angles. Preferably, the extent of the beveled surface is adapted to the extent of the positive-engagement means such as to ensure interchangeability of the engaged positive-engagement means when the spring element rests against the beveled surface. The positive-engagement means are suitably formed of grooves and elevations of prismatic configuration.

Embodiments of the present invention will be described in the following with reference to the accompanying drawings, in which.

Figure 1:
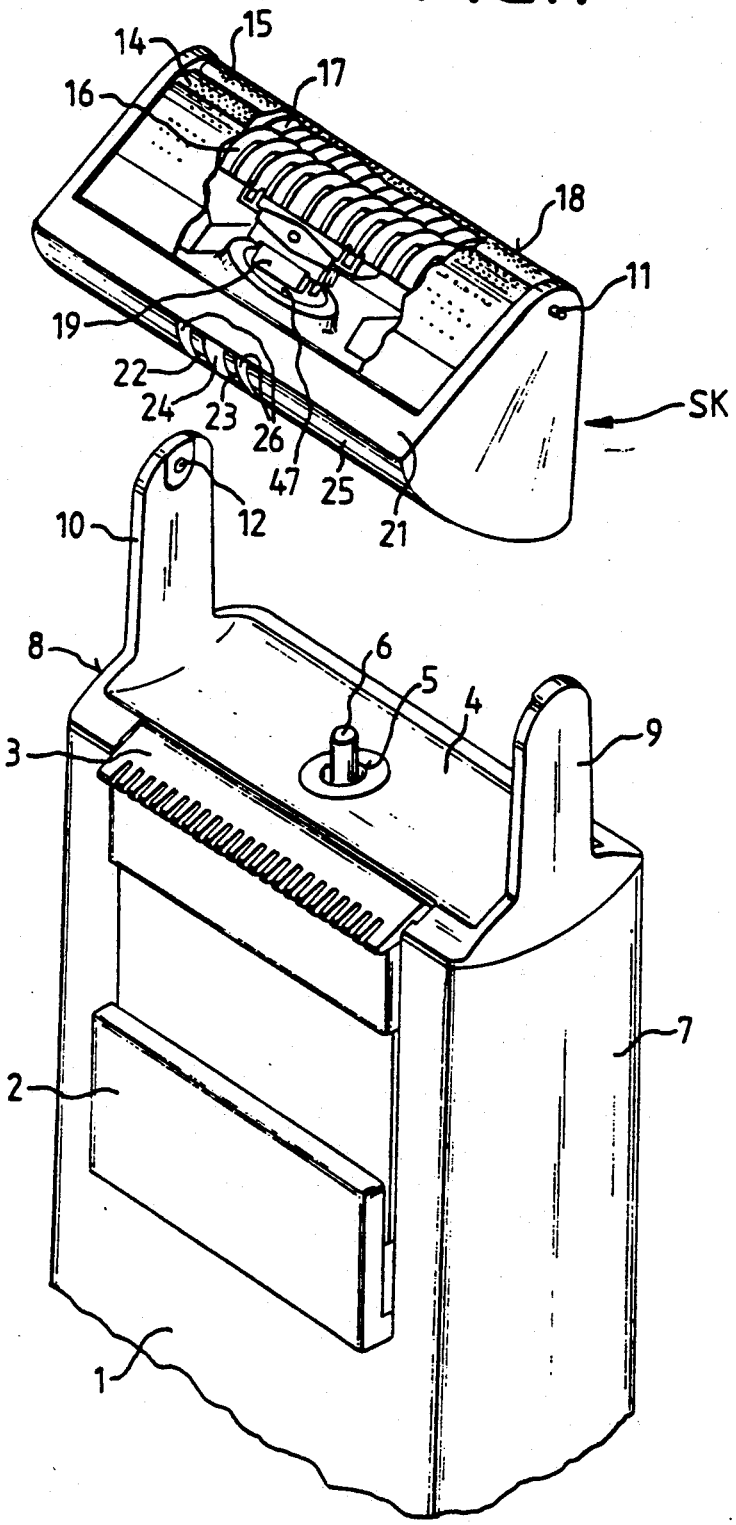
FIG. 1 is a perspective view of a portion of a dry shaving apparatus with the shaving head removed.

Referring now to FIG. 1 showing the upper portion of a dry shaving apparatus, reference numeral 1 identifies the casing thereof, 2 the ON/OFF switch, 3 the long-hair trimmer, 4 the casing upper end, 6 the drive pin extending out of the opening 5 in the casing upper end 4, reference numerals 9 and 10 designate bracket arms forming an extension of the casing narrow sides 7 and 8, and SK relates to the shaving head assembly which is pivotally carried on bearing pins 11 engaging in bearing bores 12 provided in the bracket arms.

The shaving head assembly SK shows a pair of parallel shaving heads 14 and 15 comprising two inner cutters 16 and 17 as well as a shaving foil 18 engaging the inner cutters in arched form. The inner cutters 16 and 17 are resiliently mounted on a common coupling member 19 — see FIG. 2. The coupling member 19 is coupled to a drive member 47 which is part of an oscillating bridge mounted in the shaving head frame 21 — see FIGS. 2 and 3. For transmitting the driving motion from the drive pin 6 to the oscillating bridge, the latter is provided with two transverse rib members 22 and 23 with a space 24 between them for engagement by the drive pin 6. When the drive is activated, the transverse rib members 22 and 23 of the oscillating bridge oscillate within the opening 26 provided in the bottom plate 25 of the shaving head frame 21.

Figure 2:
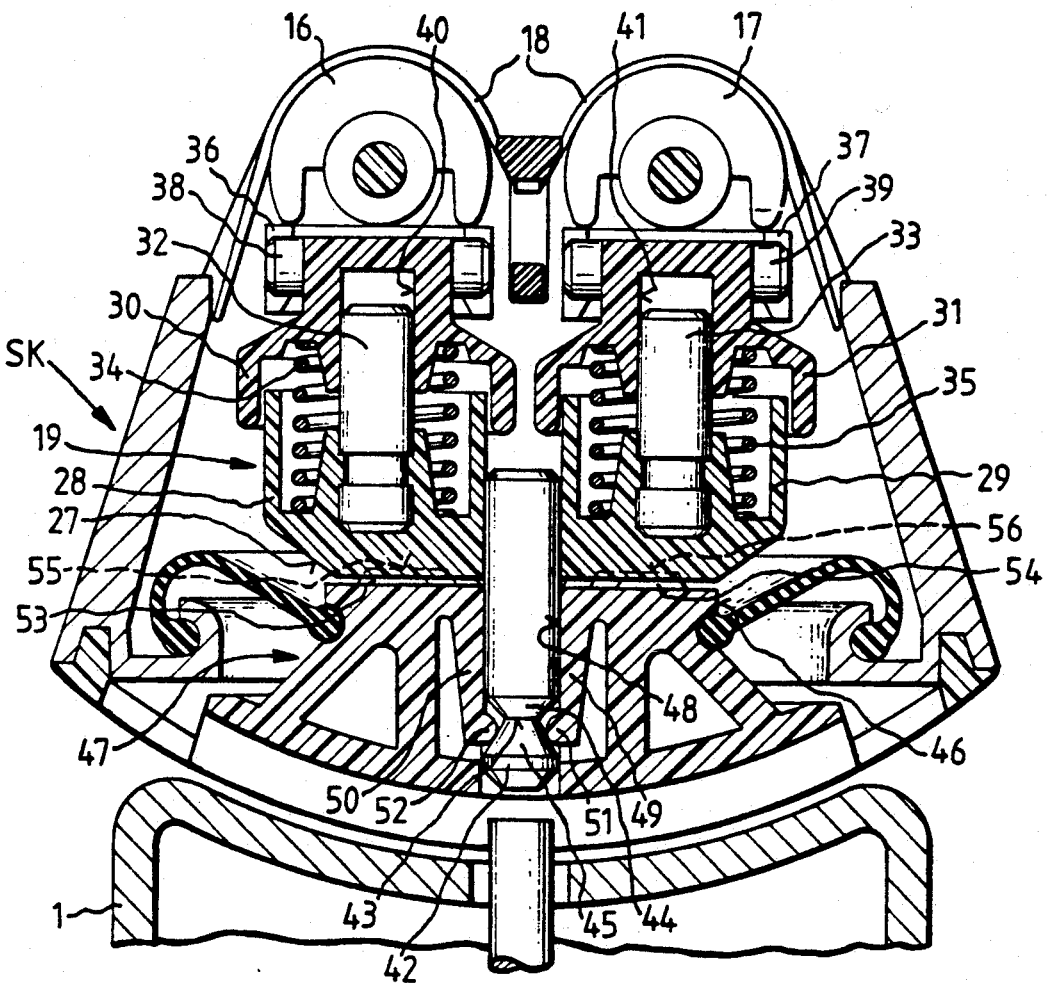
FIG. 2 is a cross-sectional view through a pivoted shaving head and the upper portion of the casing of the dry shaving apparatus.

FIG. 2 shows a cross-sectional view through the pivoted shaving head assembly SK of FIG. 1. The two inner cutters 16, 17 rest against a respective shaving foil 18 which is attached to the shaving head frame 21 in arched form and may also be an integral structure. The coupling member 19 is comprised of a bottom plate 27 having two integrally formed cup-shaped receptacles 28, 29 with respective covers 30, 31 fitting over the receptacles in cup shape, as well as respective guide pins 32, 33 disposed inside the respective receptacles 28, 29 and their associated covers 30, 31, including compression springs 34, 35 surrounding the respective guide pins. The guide pin 32 is secured in receptacle 28 and the guide pin 33 is secured in receptacle 29. In order to ensure a vertical guide of the inner cutters 16, 17 coupled to the respective covers 30, 31 against the pressure of the respective compression springs 34, 35, respective slide bores 40, 41 receiving the respective guide pins 32, 33 are formed in the respective covers 30, 31. By means of a clip connection allowing vertical up and down movement of the covers 30, 31 — see FIG. 3 —, the covers 30, 31 are coupled to the receptacles 28, 29. The inner cutters 16, 17 are pivoted at the respective upper ends of the covers 30, 31 by respective coupling means 36, 37 and respective hinge pins 38, 39 arranged transversely to the longitudinal extent of the inner cutters 16, 17 — see FIGS. 2 and 3.

Secured in the center between the two guide pins 32, 33 in the bottom plate 27 of the coupling member 19 is a bearing pin 42 which, protruding out of the bottom plate 27, extends in the direction of the casing 1. At its end remote from the bottom plate 27, the bearing pin 42 has a circumferential prismatic groove 43 with beveled surfaces 44, 45 of different gradients, the beveled surface 45 which extends towards the end of the bearing pin 42 having a gradient smaller than that of the opposite beveled surface 44.

The bearing pin 42 extends through a bearing bore 48 provided in the cover plate 46 of the drive member 47. In an extension of the bearing bore 48, two spring elements 49, 50 in the form of spring arms with integral locking cams 51, 52 are formed on the side of the cover plate 46 proximate to the casing 1. By engagement of the locking cams 51, 52 of the spring elements 49, 50 with the beveled surface 45 of the bearing pin 42, it is ensured that the bottom plate 27 of the coupling member 19 engages the cover plate 46 of the drive member 47 without relative movement, because the force acting on the beveled surface 45 which results from the spring force of the spring elements 49, 50 tends to pull the coupling member 19 towards the drive member 47.

In order to further improve the abutting engagement of the coupling member 19 with the drive member 47, at least two positive-engagement means 53 to 56 each are formed on and, respectively, in the cover plate 46 and the bottom plate 27. These positive-engagement means are preferably comprised of prismatically formed elevations 53, 54 engaging into corresponding prismatic grooves 55, 56. In addition to improving the engagement between coupling member 19 and drive member 47, the engaged positive-engagement means 53 to 56 serve the function of a defined alignment of the inner cutters 16 and 17 resiliently mounted on the coupling member 19 in the direction of oscillation.

Figure 3:
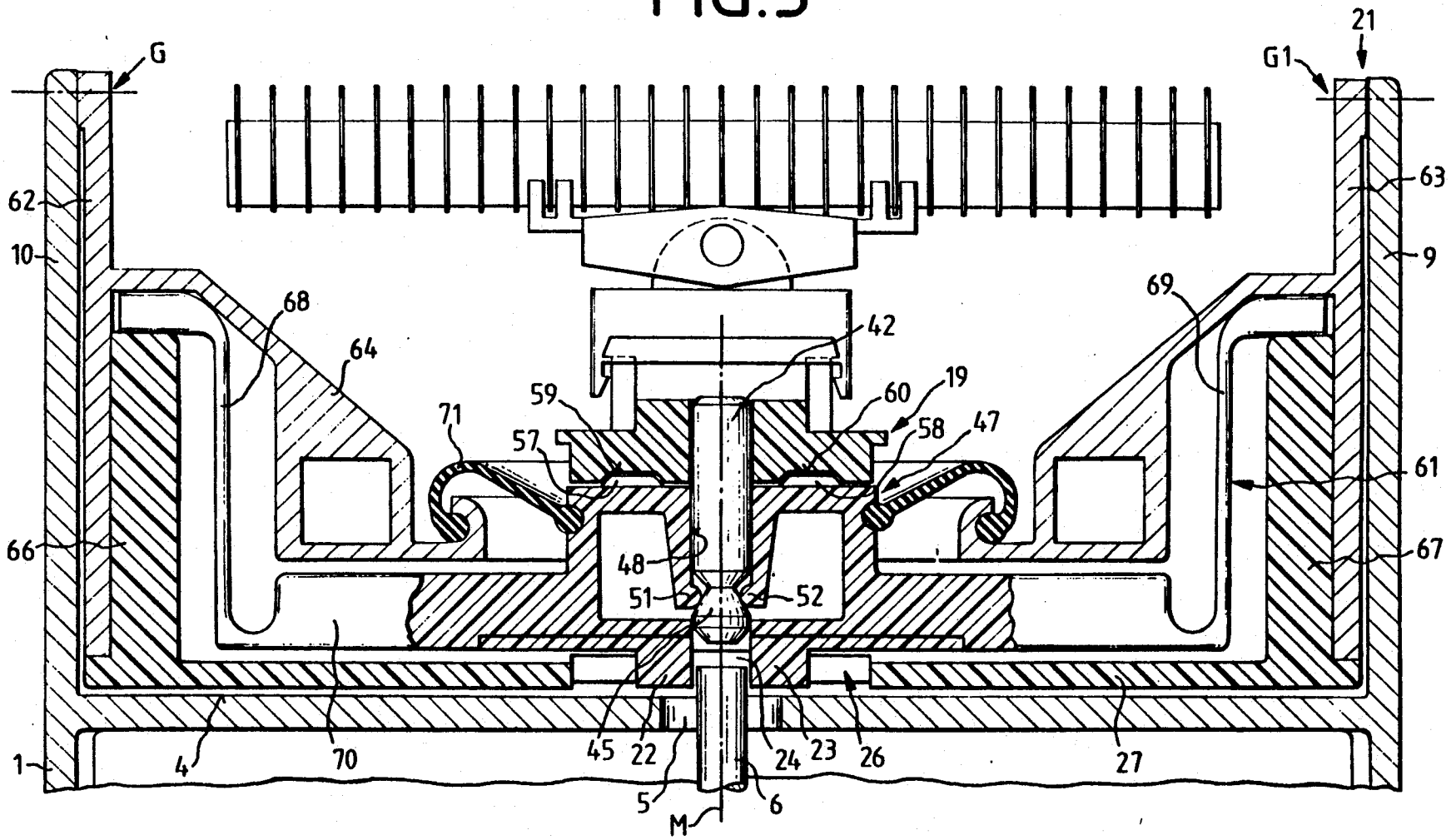
FIG. 3 is a longitudinal sectional view of a shaving head pivoted to the casing of the dry shaving apparatus.

In an embodiment which becomes apparent from the representation of FIG. 2 including the representation of FIG. 3, four positive-engagement means 53 to 60 each are arranged on the coupling member 19 and the drive member 47, such that the common center axis M of bearing pin 42 and bearing bore 4 extends through the point of intersection of the directions in which the positive-engagement means 53 to 60 extend, the directions intersecting at right angles. With the longitudinal extent of the beveled surface 45 adapted to the vertical extent, that is, the height of the positive-engagement means 53, 54, 57, 58, interchangeability of the engaged positive-engagement means is ensured when the spring elements 49, 50 rest against the beveled surface 45 with their locking cams 51, 52. Such an interchange which occurs, for example, by rotating the coupling member through 90°, causes a corresponding displacement of the inner cutters 16, 17 transversely to their direction of oscillation, allowing easy cleaning of the inner cutters 16, 17 while coupled to the drive member 47, as well as of the space in the interior of the shaving head frame 21 with the shaving foil 18 removed.

The drive member 47 of FIG. 2 is part of an oscillating bridge mounted in the pivoted shaving head assembly SK — see FIG. 1 — which will be described in greater detail with reference to FIG. 3.

Corresponding to FIG. 1, In FIG. 3 reference numeral 1 identifies the casing, 9 and 10 refer to the bracket arms integrally formed on the casing, and 6 designates the drive pin protruding from the opening 5 in the casing upper end 4 into the space 24 between the transverse rib members 22, 23 which are provided on the oscillating bridge referred to by numeral 61. The shaving head frame 21 of which in FIG. 3 the end walls 62, 63 and the inner wall 64 extending into the interior are shown, is pivoted at G, $G_1$ to the bracket arms 9 and 10 by means of a hinge joint not shown in greater detail. The bottom plate 27 closing the shaving head frame 21 is of a U-shaped configuration. The arms 66, 67 of the bottom plate 27 extend parallel to the end walls 62, 63 of the shaving head frame. Mounted on the upper ends of the arms 66, 67 is the oscillating bridge 61 which is composed of two depending spring arms 68, 69 and a plate 70 connecting the spring arms 68, 69. The bottom plate 27 has an opening 26 into which the transverse rib members 22, 23 of the oscillating bridge 61 extend for coupling with the drive pin 6. The drive member 47 serving for coupling to the coupling member 19 is formed integral with the bottom plate 70, thus being part of the oscillating bridge 61. The positive-engagement mean 57 to 60 are in relative engagement as a result of the coupled condition of coupling member 19 and drive member 47. The seal 71 has its one end attached to the drive member 47 and its other end to the inner wall 64 of the shaving head frame.

Figure 5:
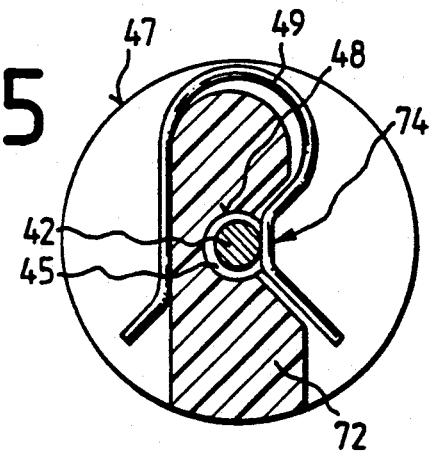
FIG. 5 is a cross-sectional view through a drive member with spring element, taken along the line A—A of FIG. 4.
Figure 4:
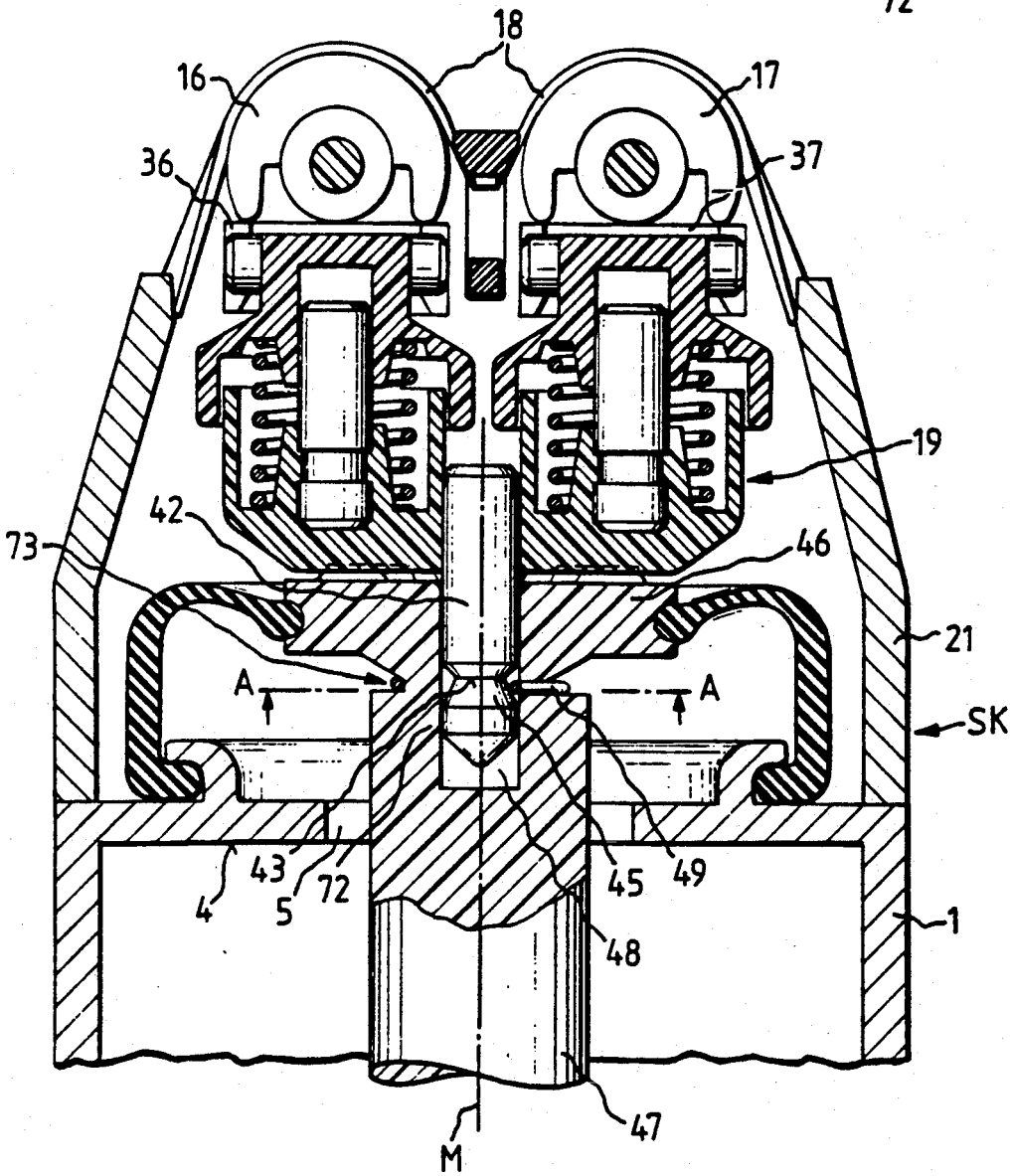
FIG. 4 is a cross-sectional view through a shaving head frame arranged on the casing of the dry shaving apparatus.

In the embodiment of FIG. 4, the shaving head assembly SK is immovably arranged on the casing i of the dry shaving apparatus. The configuration of the coupling member 19 as well as the inner cutters 16 and 17 pin-joined by the coupling means 36, 37 corresponds to the configuration described in detail with reference to FIG. 2. The oscillating drive member 47 projects with its end serving a coupling function with the coupling member 19 through the opening 5 provided in the casing upper end 4 into the space in the interior of the shaving head assembly SK. The drive member 4 is comprised of a drive pin having a bearing bore 48 in the form of a blind-end bore arranged on its center axis M and a groove 73 provided on the outside of the bearing bore wall 72 for receiving a spring element 49. The groove 73 extends in the bearing bore wall 72 in such a manner as to partially intersect the space in the interior of the bearing bore 48, as illustrated in more detail in FIG. 5 by the section taken along the line A—A of FIG. 4, reference being had to the numerals of FIG. 4. In this embodiment, the spring element 49 is comprised of a substantially U-shaped clamp having an arcuate section 74 extending towards the bearing bore 48 for partial engagement in the bearing bore 48. The relative distance of the groove 73 to the cover plate 46 of the drive member 47 is dimensioned such that, with the bearing pin 42 of the coupling member 19 engaged in the bearing bore 48, the spring element 49 comes to rest against the beveled surface 45 of the prismatic groove 43 provided on the bearing pin 42, in order to ensure relative coupling and engagement of coupling member 19 and drive member 47 by means of the spring action produced by the spring element 49. Following removal of the shaving head frame 21 together with the shaving foil 18 attached thereto from the casing 1, the coupling member 19 with the inner cutters 16 and 17 resiliently mounted thereon can be readily disengaged from the drive member 47 against the spring action of the spring element 49. The end of the bearing pin 42 is conically shaped in order to simplify its insertion into the bearing bore in addition to facilitating the expansion of the spring element 49 during assembly.

We claim:

1. A dry shaving apparatus comprising an electric drive, drive structure coupled to said electric drive, said drive structure including a bearing bore, coupling structure, a pair of parallel elongate shaving heads having their inner cutters resiliently mounted on said coupling structure, said coupling structure being detachably coupled to said drive bearing bore in said drive structure, said bearing pin structure having a prismatic groove with two beveled surfaces, at least one spring element adapted to hold said coupling structure in abutting engagement with said drive structure, said spring element and said prismatic groove cooperating as a locking device with said spring element resting resiliently against one of said beveled surfaces in a locked position, said locking device being releasable from its locking engagement against the pressure of said spring element by means of said beveled surface of said prismatic groove against which said spring element rests.

2. The dry shaving apparatus of claim 1 wherein said beveled surfaces of said prismatic groove on said bearing pin structure have different gradients, the beveled surface with the smaller gradient being acted upon by said spring element in a coupled condition of said coupling structure and said drive structure.

3. The dry shaving apparatus of claim 1 wherein said bearing bore terminates in a hollow space in said drive structure, and said spring element includes at least one spring arm which extends into said hollow space and is integrally formed on said drive structure in an extension of said bearing bore.

4. The dry shaving apparatus of claim 3 wherein said apparatus includes a shaving head frame and said drive structure is part of an oscillating bridge arranged in said shaving head frame.

5. The dry shaving apparatus of claim 3 wherein said apparatus includes a casing, and said drive structure is part of an oscillating bridge arranged in said casing.

6. The dry shaving apparatus of claim 1 wherein said drive structure includes an oscillating drive pin member having a center axis (M), said bearing bore being arranged on said center axis (M) and a groove on the outside of said pin member for receiving said spring element, said groove partially intersecting the space in the interior of said bearing bore.

7. The dry shaving apparatus of claim 6 wherein said spring element is a spring clip conformed to the contour of said groove and partially extending into the space in the interior of said bearing bore.

8. The dry shaving apparatus of claim 1 further includes positive-engagement structure of said coupling structure and on said drive structure, said positive-engagement structure including portions for relative engagement and for determining the alignment of said inner cutters.

9. The dry shaving apparatus of claim 8 wherein said inner cutters are driven by said drive structure in a direction of reciprocating oscillation and said coupling structure and said drive structure are each provided with two spaced portions of said positive-engagement structure that are disposed along a line parallel to said direction of oscillation of said inner cutters.

10. The dry shaving apparatus of claim 8 wherein said coupling structure and said drive structure are each provided with four portions of said positive-engagement structure, two of said portions defining a first line and the other two of said portions defining a second line, said lines intersecting at right angles, and said bearing bore and said bearing pin structure having a common center axis (M) that extends through the point of intersection of said lines.

11. The dry shaving apparatus of any one of claims 8 to 10 wherein said beveled surface and said positive-engagement structure have similar annular extents to provide interchangeability of said positive-engagement structure when said spring element rests against said beveled surface.

12. The dry shaving apparatus of any one of claims 8 to 10 wherein said positive-engagement structure is formed of grooves and elevations of prismatic configuration.

* * * * *